US009972473B2

(12) United States Patent
Yoshizawa

(10) Patent No.: US 9,972,473 B2
(45) Date of Patent: May 15, 2018

(54) ENVELOPE ROTATION TYPE X-RAY TUBE APPARATUS

(71) Applicant: SHIMADZU CORPORATION, Kyoto-shi, Kyoto (JP)

(72) Inventor: Tatsuya Yoshizawa, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 98 days.

(21) Appl. No.: 14/768,413

(22) PCT Filed: Dec. 3, 2013

(86) PCT No.: PCT/JP2013/082488

§ 371 (c)(1),
(2) Date: Aug. 17, 2015

(87) PCT Pub. No.: WO2014/125702

PCT Pub. Date: Aug. 21, 2014

(65) Prior Publication Data

US 2015/0380201 A1 Dec. 31, 2015

(30) Foreign Application Priority Data

Feb. 18, 2013 (JP) ..... 2013-029186

(51) Int. Cl.
*H01J 35/16* (2006.01)
*H01J 35/30* (2006.01)

(52) U.S. Cl.
CPC ..... *H01J 35/16* (2013.01); *H01J 35/305* (2013.01); *H01J 2235/168* (2013.01)

(58) Field of Classification Search
CPC ..... H01J 2235/168; H01J 35/16; H01J 35/305
See application file for complete search history.

(56) References Cited

U.S. PATENT DOCUMENTS 6,181,771 B1 * 1/2001 Hell ..... H01J 35/305 378/119
7,082,188 B2 * 7/2006 Deuringer ..... H05G 1/52 378/113

(Continued)

FOREIGN PATENT DOCUMENTS

DE 19900467 A1 4/2000
DE 19854480 A * 6/2000 ..... H01J 35/20

(Continued)

OTHER PUBLICATIONS

English machine translation of DE 10313897.*

(Continued)

*Primary Examiner* — David J Makiya
*Assistant Examiner* — Soorena Kefayati
(74) *Attorney, Agent, or Firm* — McDermott Will & Emery LLP

(57) ABSTRACT

In an envelope rotation type X-ray tube apparatus, a cathode releases electrons, and the electrons released from the cathode are deflected by deflection coils. A target generates X-rays by being bombarded with the electrons deflected by the deflection coils. Here, a shield ring, while allowing passage through a ring interior of those of the electrons deflected by the deflection coils that head for an area of the target set beforehand, blocks electrons heading outward of the area. Consequently, the electrons are inhibited from bombarding on areas of the target outward of the area and an envelope. This can prevent damage to the envelope.

4 Claims, 4 Drawing Sheets

(56) References Cited

U.S. PATENT DOCUMENTS

| | | | | |
|---|---|---|---|---|
| 7,382,865 | B2 * | 6/2008 | Deutscher | G21F 3/00 378/137 |
| 7,835,499 | B2 * | 11/2010 | Yu | H01J 25/02 378/119 |
| 9,208,986 | B2 * | 12/2015 | Zou | H01J 35/025 |
| 2004/0208287 | A1 | 10/2004 | Deuringer | |
| 2010/0195799 | A1 * | 8/2010 | Tomita | H01J 35/14 378/138 |

FOREIGN PATENT DOCUMENTS

| | | | | |
|---|---|---|---|---|
| DE | 19854480 | A1 | 6/2000 | |
| DE | 10313897 | A1 * | 10/2004 | H01J 35/14 |
| DE | 102010022595 | A1 | 12/2011 | |
| GB | 365432 | A * | 1/1932 | H01J 35/305 |
| JP | 2011-141956 | A | 7/2011 | |

OTHER PUBLICATIONS

English machine translation of DE 19854480.*
Supplementary European Search Report EP Application No. 13875076.5 dated Mar. 18, 2016.
International Search Report and Written Opinion of International Application No. PCT/JP2013/082488 dated Feb. 10, 2014 with English translation of Search Report.
Office Action issued in European Patent Application No. 13875076.5 dated Feb. 13, 2017.

* cited by examiner

ENVELOPE ROTATION TYPE X-RAY TUBE APPARATUS

RELATED APPLICATIONS

This application is the U.S. National Phase application under 35 U.S.C. § 371, of international Application No. PCT/JP2013/082488, filed on Dec. 3, 2013, which in turn claims the benefit of Japanese Application No. 2013-029186, filed on Feb. 18, 2013, the disclosures of which Applications are incorporated by reference herein.

TECHNICAL FIELD

This invention relates to an envelope rotation type X-ray tube apparatus having an envelope rotatable with a target.

BACKGROUND ART

A conventional X-ray tube apparatus, as shown in FIG. 4, includes a cathode 105 which releases electrons (also called thermion or electron beams), deflection coils 106 which deflect the electrons released from the cathode 105, a target 107 which generates X-rays (with sign xr in FIG. 4) by allowing the electrons deflected by the deflection coils 106 to bombard on its disk peripheries (see Patent Document 1, for example). An envelope rotation type X-ray tube 101 has an envelope 102 rotatable about a rotation center line R with the target 107. The target 107 is an anode.

A tube voltage is applied between the cathode 105 and the target 107 which is an anode. The tube voltage is a voltage for accelerating the electrons released from the cathode 105. An amount of deflection of the electrons deflected by the deflection coils 106 depends on the tube voltage. Therefore, in order to keep constant focal positions for causing the electrons to bombard on positions of the target 107 set beforehand and generate X-rays, an amount of current flowing to the deflection coils 106 is controlled according to variations in the tube voltage.

Patent Document 2 discloses a construction for capturing recoil electrons, among electrons having bombarded on a rotating anode target, which repeat scattering without being converted into heat or X-rays.

PRIOR ART DOCUMENTS

Patent Documents

[Patent Document 1]
US 2004/0208287
[Patent Document 2]
Unexamined Patent Publication No. 2011-141956.

SUMMARY OF INVENTION

Technical Problem

In the conventional apparatus 101 shown in FIG. 4, control is made to apply the tube voltage, for example, after fixing the current flowing to the deflection coils 106. At this time, when the tube voltage is low, the amount of deflection of the electrons will become large. When the amount of deflection of the electrons is large, the electrons will strike outer peripheral parts outward of a focal track of the target 107, or will strike the envelope 102. At a rise time and a fall time of the tube voltage, as shown in FIG. 5, there inevitably exist periods when the tube voltage is low, though short in time. In such periods, the amount of deflection of the electrons becomes large, causing the electrons to strike the envelope 102.

The tube voltage is usually controlled to have a predetermined value, but this control may fail to attain perfection when a discharge occurs between the cathode 105 and the target 107 which is an anode. There can also be a case where the tube voltage lowers temporarily. Further, malfunctioning of a high voltage power source can lower the tube voltage below a set value. In such cases, the electrons will strike the envelope 102.

The envelope 102 may be damaged when the electrons strike the envelope 102. The envelope 102 is usually made of stainless steel or a Ti (titanium) alloy, which can melt even with a brief irradiation of electron beam. Particularly an X-ray emitting window 102*b* of the envelope 102 is set to a small thickness from the necessity for X-ray transmission. Therefore, when the X-ray emitting window 102*b* is damaged, there is a possibility of vacuum leakage. When the electrons strike the envelope 102, there is also a possibility of the envelope 102 becoming melted, with constituents of the envelope 102 scattering to the target 107.

Numerous soft X-rays are included in X-rays which are generated by the electrons accelerated when the tube voltage is low and bombarding on the target 107. Soft X-rays have low transmittance with respect to the human body and tend to be absorbed by the human body. This amounts to the patient being irradiated with X-rays not contributing to diagnosis, which results in a disadvantage such as of increasing the patient's exposure to the X-rays. It is therefore desired to reduce the soft X-rays.

This invention has been made having regard to the state of the art noted above, and its object is to provide an envelope rotation type X-ray tube apparatus which prevents damage to an envelope caused by electron bombardment. A further object is to provide an envelope rotation type X-ray tube apparatus which reduces soft X-rays.

Solution to Problem

To fulfill the above object, this invention provides the following construction. An envelope rotation type X-ray tube apparatus according to this invention comprises a cathode for releasing electrons; an electron deflector for deflecting the electrons released from the cathode; a target for generating X-rays by being bombarded with the electrons deflected by the electron deflector; a shield ring, while allowing passage through a ring interior of those of the electrons deflected by the electron deflector that head for an area of the target set beforehand, blocks electrons heading outward of the area; and an envelope containing the cathode, the target and the shield ring, and rotatable with the target.

With the envelope rotation type X-ray tube apparatus according to this invention, the cathode releases electrons, and the electrons released from the cathode are deflected by the electron deflector. The target generates X-rays by being bombarded with the electrons deflected by the electron deflector. Here, the shield ring allows passage through the ring interior of those of the electrons deflected by the electron deflector that head for the area of the target set beforehand, and blocks the electrons heading outward of that area. Consequently, the electrons are inhibited from bombarding on areas of the target outward of the area and the envelope. This can prevent damage to the envelope.

In the envelope rotation type X-ray tube apparatus according this invention, it is preferred that the shield ring is rotatable with the envelope and the target. Consequently, even if the shield ring frequently undergoes a bombardment with electrons when blocking the electrons, the electron bombardment is dispersed, thereby to inhibit melting of the shield ring.

It is preferred that the envelope rotation type X-ray tube apparatus according to this invention comprises a controller for controlling, in a state of giving an electron deflecting force set beforehand by the electron deflector, to perform one of application of a tube voltage set beforehand between the cathode and the target and removal of the tube voltage applied. Consequently, the electrons at a time of low tube voltage are blocked by the shield ring against bombardment on the target, thereby to be able to reduce soft X-rays included in the generated X-rays. Further, it is not necessary for the controller to control the deflecting force given to the electron deflector according to the tube voltage, which can simplify control of the electron deflector.

In the envelope rotation type X-ray tube apparatus according this invention, it is preferred that the shield ring is formed of one of tungsten, molybdenum, tantalum, and an alloy having one of these as a main constituent. That is, the shield ring is formed of metal with a high melting point. Therefore, when blocking the electrons with the shield ring, melting of the shield ring is inhibited even under frequent bombardment with the electrons.

In the envelope rotation type X-ray tube apparatus according this invention, it is preferred that the shield ring is disposed in a portion having the smallest diameter of the envelope. This allows the shield ring to be formed small.

In the envelope rotation type X-ray tube apparatus according this invention, it is preferred that the shield ring is disposed in a position closer to the target than a portion having the smallest diameter of the envelope. Consequently, the blocking portion of the shield ring has an increased circumference, to be able to receive the electrons in an enlarged area.

Advantageous Effects of Invention

With the envelope rotation type X-ray tube apparatus according to this invention, the cathode releases electrons, and the electrons released from the cathode are deflected by the electron deflector. The target generates X-rays by being bombarded with the electrons deflected by the electron deflector. Here, the shield ring allows passage through the ring interior of those of the electrons deflected by the electron deflector that head for the area of the target set beforehand, and blocks the electrons heading outward of that area. Consequently, the electrons are inhibited from bombarding on areas of the target outward of the area and the envelope. This can prevent damage to the envelope.

DESCRIPTION OF EMBODIMENTS

Figure 1:
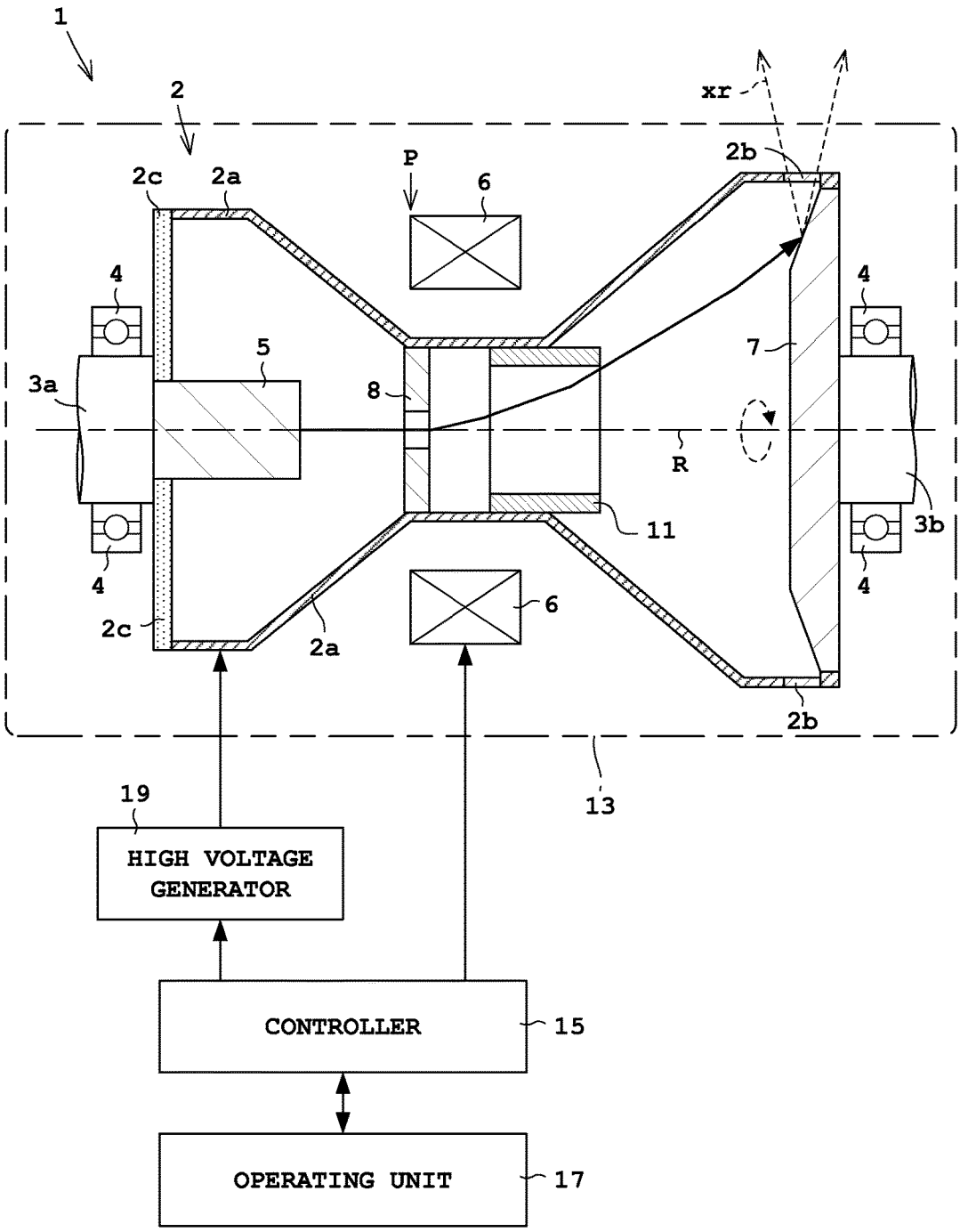
FIG. 1 is a schematic view of an envelope rotation type X-ray tube apparatus according to an embodiment.
Figure 2:
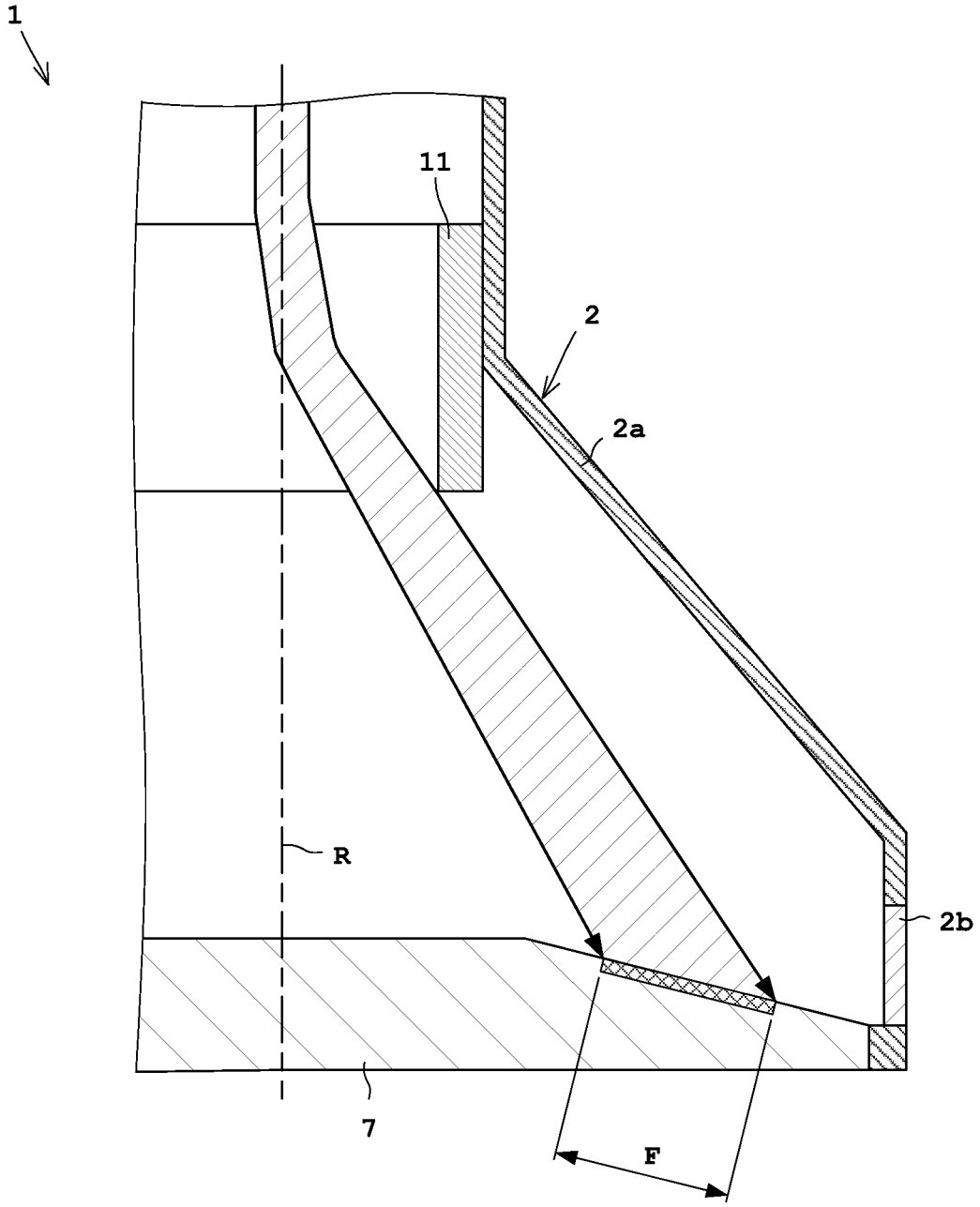
FIG. 2 is an enlarged fragmentary view of the envelope rotation type X-ray tube apparatus according to the embodiment, showing a way electrons pass through a ring interior of a shield ring and bombard on an area of a target.

An embodiment of this invention will be described hereinafter with reference to the drawings. FIG. 1 is a schematic view of an envelope rotation type X-ray tube apparatus according to the embodiment. FIG. 2 is an enlarged view of a portion of FIG. 1.

Reference is made to FIG. 1. An envelope rotation type X-ray tube apparatus 1 includes an envelope 2 shaped to have a constricted middle portion. The envelope 2 has rotary shafts 3*a* and 3*b* arranged at opposite ends thereof. The rotary shafts 3*a* and 3*b* are rotatably supported by bearings 4. The envelope 2 has an envelope body 2*a*, an X-ray emitting window 2*b* and an insulating wall 2*c*. The envelope body 2*a* is formed of stainless steel, Ti or the like while the X-ray emitting window 2*b* is formed of Ti or the like. The insulating wall 2*c* is formed of an insulating material such as ceramics. The X-ray emitting window 2*b* is set to a small thickness from the necessity for X-ray transmission as noted hereinbefore.

Further, the envelope rotation type X-ray tube apparatus 1 includes a cathode 5 which releases electrons, deflection coils 6 which deflect the electrons released from the cathode 5, and a target 7 which generates X-rays by being bombarded with the electrons deflected by the deflection coils 6. The cathode 5 and target 7 are arranged opposite each other on a rotation center line R. The cathode 5 releases the electrons toward the target 7 along the rotation center line R. The cathode 5 has a disk-shaped electron emission source (emitter) and a converging electrode (neither shown).

The deflection coils 6 are arranged outside and adjacent the constriction of the envelope 2. Although two deflection coils 6 are arranged opposite each other across the rotation center line R in FIG. 1, four deflection coils 6 are provided like a quadrupole coil, for example. The four deflection coils 6 can deflect the electrons upward, downward and in the depth directions of the plane of the drawing. The deflection coils 6 correspond to the electron deflector in this invention.

The target 7 is formed of metal with a high melting point such as tungsten or molybdenum. The target 7 serves as an outer wall of the envelope 2 as shown in FIG. 1, and the rotary shaft 3*b* is provided on the target 7. In this connection, instead of the target 7 serving as the outer wall, the envelope 2 may be provided to cover an outer wall adjacent the target 7, with the target 7 attached to this outer wall. The same applies also to the cathode 5.

Between the cathode 5 and deflection coils 6, an electron accelerating and converging element (also called an anode) 8 is provided for accelerating and converging the electrons released from the cathode 5. The electron accelerating and converging element 8 is an anode, and not only the electron accelerating and converging element 8, but the envelope body 2*a*, X-ray emitting window 2*b* and target 7 are also anodes. That is, the electron accelerating and converging element 8 is at the same potential as the envelope body 2*a*, X-ray emitting window 2*b* and target 7.

Next, a shield ring 11 which is the characterizing portion of this invention will be described. The shield ring 11 is a ring-shaped (cylindrical) member, and is attached to the envelope body 2*a*. The shield ring 11 is formed of tungsten, molybdenum or tantalum, or an alloy having one of these as a main constituent. That is, the shield ring 11 is formed of metal with a high melting point. Therefore, when blocking the electrons with the shield ring 11, melting of the shield ring 11 is inhibited even under frequent bombardment with the electrons.

The shield ring 11, while allowing passage through the ring interior of those of the electrons deflected by the deflection coils 6 that head for an area F (see FIG. 2) of the target 7 defining a focal track set beforehand, blocks the electrons heading outward of that area F. That is, the electrons deflected by the deflection coils 6 pass through the ring interior of the shield ring 11, and reach the area F of the target 7 defining the focal track set beforehand. When the amount of deflection of the electrons by the deflection coils 6 is enlarged, the electrons will strike the inner wall of the shield ring 11 to be captured. The electrons are therefore prevented from flying to outer peripheries outward of the area F of the target 7 defining the focal track set beforehand, and to the envelope 2 and X-ray emitting window 2*a*. The focal track is a track of focal positions where the electrons bombard to generate X-rays, and is formed to describe a circle on the target 7.

The side of the shield ring 11 opposed to the target 7 is set such that an outer side of the area F of the target 7 defining the focal track be a boundary. On the other hand, the side of the shield ring 11 opposed to the cathode 5 is set to cover a range where bombardments on the envelope 2 are assumed to occur as a result of large deflections by the deflection coils 6.

Incidentally, the envelope rotation type X-ray tube apparatus 1 has the entire envelope 2 rotated in use. That is, the envelope 2, rotary shafts 3*a* and 3*b*, cathode 5, target 7, electron accelerating and converging element 8 and shield ring 11 are integrated, and these integrated envelope 2 and so on are rotated about the rotation center line R by a driver such as a motor not shown. The shield ring 11 is therefore constructed to rotate with the envelope 2 and target 7. Consequently, even if the shield ring 11 frequently undergoes a bombardment with electrons when blocking the electrons, the electron bombardment is dispersed, thereby to inhibit melting of the shield ring 11.

A space surrounded by the envelope 2 and target 7 is in a vacuum state. The envelope 2 and so on are contained in a housing 13, and a space between the envelope 2 and so on and the housing 13 is filled with insulating oil.

Reference is made back to FIG. 1. The envelope rotation type X-ray tube apparatus 1 includes a controller 15 for performing overall control of the respective components of this apparatus 1, an operating unit 17 for operating the envelope rotation type X-ray tube apparatus 1, and a high voltage generator (high voltage power source) 19 for supplying a tube voltage and a tube current required for X-ray generation. The operating unit 17 is made up of switches, a touch panel input unit and so on.

The controller 15 is formed of a central processing unit (CPU) and so on. The controller 15 controls rotation of the envelope 2, controls a power source not shown to supply a current set beforehand to the deflection coils 6, and controls the high voltage generator 19 to supply the tube current and tube voltage between the cathode 5 and the anodes such as the electron accelerating and converging element 8 and so on. In a state of applying an amount of current set beforehand to the deflection coils 6 to give an electron deflecting force set beforehand by the deflection coils 6, the controller 15 applies the tube voltage set beforehand between the cathode 5 and the target 7, electron accelerating and converging element 8 and so on. Further, in the state of giving the electron deflecting force set beforehand by the deflection coils 6, the controller 15 removes the applied tube voltage.

Next, operation of the envelope rotation type X-ray tube apparatus 1 will be described. The cathode 5 releases electrons, and the electron accelerating and converging element 8 accelerates and converges the electrons released from the cathode 5. The deflection coils 6 deflect the accelerated and converged electrons. The deflected electrons pass through the ring interior of the shield ring 11, and bombard on focal positions set beforehand on disk peripheries of the target 7. X-rays generate from the focal positions of the target 7 where the electrons have bombarded, and are emitted outward of the envelope rotation type X-ray tube apparatus 1 through the X-ray emitting window 2*b*.

Here, the shield ring 11 allows passage through the ring interior of those of the electrons deflected by the deflection coils 6 that head for the area F of the target 7 defining the focal track set beforehand, and blocks the electrons heading outward of that area F. Consequently, the electrons are prevented from striking areas of the target 7 outward of the area F and the envelope 2 such as the X-ray emitting window 2*b*. Since the shield ring 11 is formed of metal with a high melting point, melting of the shield ring 11 is inhibited even under frequent bombardment with the electrons. Further, since the shield ring 11 rotates with the envelope 2 and target 7, the electron bombardment can be dispersed even if the electrons bombard frequently, thereby to inhibit melting of the shield ring 11.

Figure 5:
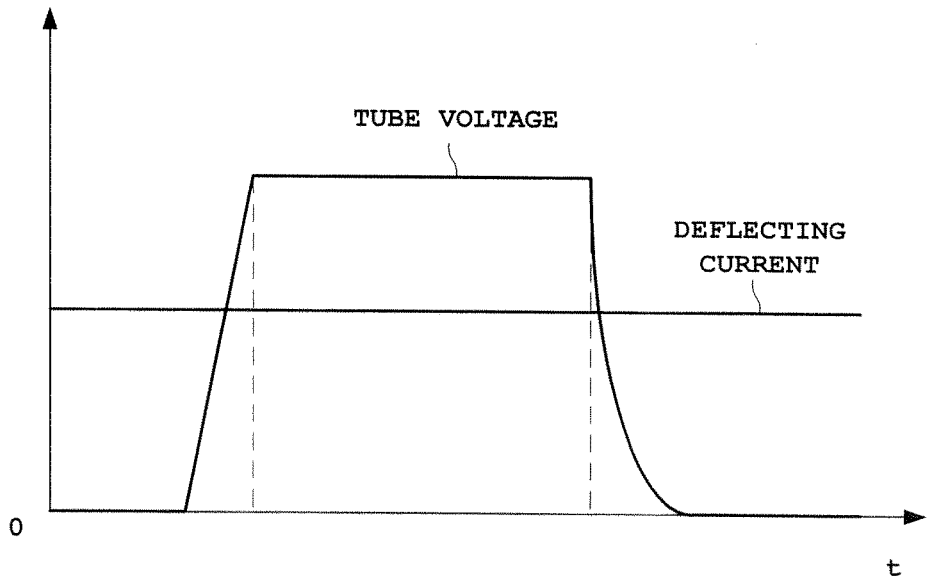
FIG. 5 is a view showing a relationship between tube voltage and deflecting current, with a horizontal axis representing time.

In the state of applying the amount of current set beforehand to the deflection coils 6, as shown in FIG. 5, to give an electron deflecting force set beforehand to the deflection coils 6, the controller 15 generates X-rays by applying the tube voltage set beforehand between the cathode 5 and the target 7, electron accelerating and converging element 8 and so on. Further, in the state of giving the electron deflecting force set beforehand to the deflection coils 6, the controller 15 removes the applied tube voltage to stop the generation of X-rays.

As noted hereinbefore, at the rise and fall of the tube voltage waveform shown in FIG. 5, there occur periods when the tube voltage is low. At such times, the amount of deflection of the electrons by the deflection coils 6 will become large, whereby the electrons will head for the envelope 2 and so on. The electrons heading for the envelope 2 and so on are blocked by the shield ring 11. There is the following technique also. That is, there is a technique which, when the amount of deflection of the electrons becomes large, controls the amount of current applied to the deflection coils 6 to cause the deflected electrons to head for the area F defining the focal track. This technique would bring about a different problem that numerous soft X-rays not contributing to diagnosis will be included in the X-rays generated by a bombardment resulting from acceleration by a low tube voltage.

However, the controller 15, in the state of applying the amount of current set beforehand to the deflection coils 6 as in this embodiment, selectively performs either application of the tube voltage set beforehand or removal of the applied tube voltage. At this time, those of the electrons deflected by the deflection coils 6 that head for the area of the target 7 set beforehand are allowed to pass through the ring interior of the shield ring 11, and the electrons heading outward of that area are blocked by the shield ring 11. Consequently, the envelope 2 and so on are shielded against the electrons heading therefor, and the electrons at a time of low tube voltage are blocked by the shield ring 11 against bombardment on the target 7, thereby to be able to reduce soft X-rays included in the generated X-rays. Further, it is not necessary for the controller 15 to control the amount of current flowing to the deflection coils 6 according to the tube voltage, which can simplify control of the deflection coils 6.

According to this embodiment, the cathode 5 releases electrons, and the electrons released from the cathode 5 are deflected by the deflection coils 6. The target 7 generates X-rays by being bombarded with the electrons deflected by the deflection coils 6. Here, the shield ring 11 allows passage through the ring interior of those of the electrons deflected by the deflection coils 6 that head for the area F of the target 7 set beforehand, and blocks the electrons heading outward of that area F. Consequently, the electrons are inhibited from bombarding on areas of the target 7 outward of the area F and the envelope 2. This can prevent damage to the envelope 2.

This invention is not limited to the foregoing embodiment, but may be modified as follows:

(1) In the foregoing embodiment, as shown in FIG. 1, the shield ring 11 is disposed in the thinnest portion of the envelope 2 having a constricted shape. That is, the shield ring 11 is disposed in a portion adjacent the deflection coils 6 with the smallest diameter of the envelope 2 around the rotation center line R. However, this is not limitative.

Figure 3:
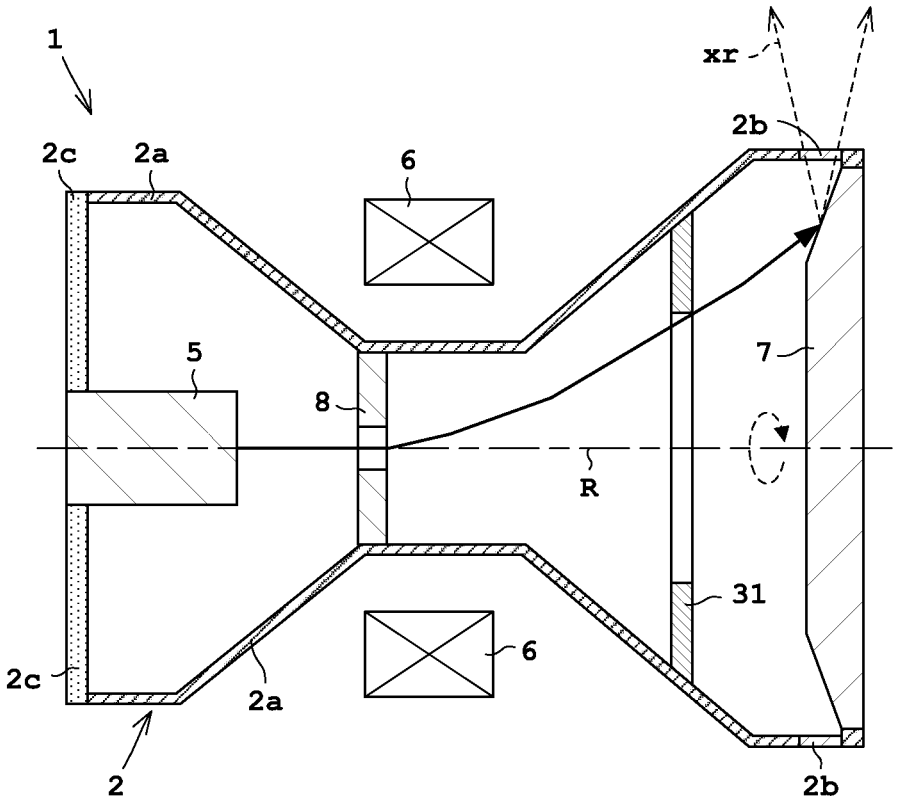
FIG. 3 is a schematic view of an envelope rotation type X-ray tube apparatus according to a modification.

As shown in FIG. 3, for example, a shield ring 31 may be disposed in a portion adjacent the target 7 with a larger diameter of the envelope 2 than the portion adjacent the deflection coils 6 with the smallest diameter of the envelope 2 around the rotation center line R. Since, as a result, the shield ring 31 will block electrons in a position farther away from the rotation center line R than the case of being located adjacent the deflection coils 6, the blocking portion of the shield ring 31 has a longer circumference than that of the shield ring 11 adjacent the deflection coils 6, to be able to receive the electrons in an enlarged area. Therefore, even if the shield ring 31 frequently undergoes a bombardment with the electrons when blocking the electrons, the electron bombardment is further dispersed. This can inhibit melting of the shield ring 31, and can reduce concern about melting.

On the other hand, the shield ring 11 adjacent the deflection coils 6 shown in FIG. 1 can be formed small compared with the shield ring 31 adjacent the target 7 shown in FIG. 3. The shield rings 11 and 31 may be disposed in any position between the electron accelerating and converging element 8 and target 7. Specifically, since the electrons are deflected by the deflection coils 6, any position is appropriate as long as it is in a space from ends (sign P in FIG. 1) opposed to the cathode 5 of the deflection coils 6 to the target 7.

(2) In the foregoing embodiment and modification (1), the shield ring 11 shown in FIG. 1 or the shield ring 31 shown in FIG. 3 is formed in one piece, but may be formed of a plurality of pieces. For example, the shield ring 11 shown in FIG. 1 and the shield ring 31 shown in FIG. 3 may be combined. That is, the shield rings 11 and 31 are disposed in the portion with the smallest diameter of the envelope 2, and in a portion closer to the target 7 than the portion with the smallest diameter of the envelope 2.

Figure 4:
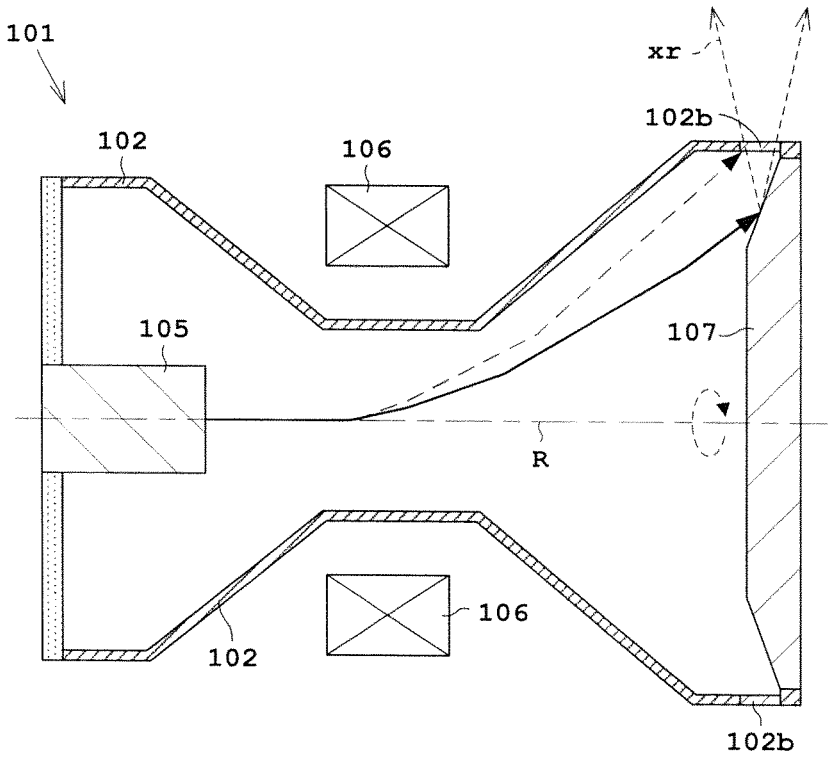
Fig. 4 (PRIOR ART)
FIG. 4 is a schematic view of a conventional envelope rotation type X-ray tube apparatus.

(3) In the foregoing embodiment and each modification, the electron accelerating and converging element 8 is provided as shown in FIG. 1. As shown in FIG. 4, the electron accelerating and converging element 8 may be omitted from the construction.

(4) In the foregoing embodiment and each modification, as the electron deflector for deflecting the electrons released from the cathode 5, the deflection coils 6 are provided which deflect the electrons by means of a magnetic field. For example, the electron deflector may deflect the electrons by means of an electric field.

REFERENCE SIGNS LIST

1 . . . envelope rotation type X-ray tube apparatus
2 . . . envelope
2*a* . . . envelope body
2*b* . . . X-ray emitting window
5 . . . cathode
6 . . . deflection coils
7 . . . target
11, 31 . . . shield rings
15 . . . controller
F . . . area
R . . . rotation center line

The invention claimed is:

1. An envelope rotation type X-ray tube apparatus comprising:

a cathode for releasing electrons;

an electron deflector for deflecting the electrons released from the cathode;

a target for generating X-rays by being bombarded with the electrons deflected by the electron deflector;

a shield ring, while allowing passage through a ring interior of those of the electrons deflected by the electron deflector that head for first area of the target, configured to block electrons heading outward of the first area, the first area defining a focal track of the electrons set beforehand; and an envelope containing the cathode, the target and the shield ring, the envelope being rotatable with the target, wherein the electron deflector is arranged outside of the envelope and adjacent to a portion having a smallest diameter of the envelope, the shield ring is disposed in the portion having the smallest diameter of the envelope, and a side of the shield ring opposed to the target is so formed that an outermost periphery of the electrons, which are allowed to pass through the ring interior of the shield ring, matches an outermost periphery of the first area of the target.

2. The envelope rotation type X-ray tube apparatus according to claim 1, wherein the shield ring is rotatable with the envelope and the target.

3. The envelope rotation type X-ray tube apparatus according to claim 1, comprising a controller for controlling, in a state of giving an electron deflecting force set beforehand by the electron deflector, to perform one of application of a tube voltage set beforehand between the cathode and the target and removal of the tube voltage applied.

4. The envelope rotation type X-ray tube apparatus according to claim 1, wherein the shield ring is formed of one of tungsten, molybdenum, tantalum, and an alloy having one of these as a main constituent.

* * * * *